US010207515B2

(12) United States Patent
Nakamura et al.

(10) Patent No.: US 10,207,515 B2
(45) Date of Patent: Feb. 19, 2019

(54) LIQUID EJECTING APPARATUS

(71) Applicant: SEIKO EPSON CORPORATION, Tokyo (JP)

(72) Inventors: Hiroyuki Nakamura, Shiojiri (JP); Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/909,483

(22) Filed: Mar. 1, 2018

(65) Prior Publication Data

US 2018/0250946 A1 Sep. 6, 2018

(30) Foreign Application Priority Data

Mar. 3, 2017 (JP) ..... 2017-040156

(51) Int. Cl.
*B41J 2/17* (2006.01)
*B41J 2/18* (2006.01)
*B41J 2/175* (2006.01)

(52) U.S. Cl.
CPC ..... *B41J 2/17596* (2013.01); *B41J 2/1707* (2013.01); *B41J 2/18* (2013.01)

(58) Field of Classification Search
CPC ..... B41J 2/18
See application file for complete search history.

(56) References Cited

U.S. PATENT DOCUMENTS

| | | | |
|---|---|---|---|
| 8,523,336 | B2 | 9/2013 | Kuribayashi |
| 9,327,514 | B2 | 5/2016 | Nishiyama et al. |
| 2011/0050793 | A1 | 3/2011 | Kumagai et al. |
| 2016/0001569 | A1 | 1/2016 | Nakamura |
| 2016/0031226 | A1 | 2/2016 | Nishiyama et al. |
| 2016/0288523 | A1 | 10/2016 | Ohtsu et al. |

FOREIGN PATENT DOCUMENTS

| | | |
|---|---|---|
| EP | 0916502 | 5/1999 |
| EP | 2468512 | 6/2012 |
| JP | 2012-030448 A | 2/2012 |
| JP | 2016-013648 A | 1/2016 |
| JP | 2016-030425 A | 3/2016 |

OTHER PUBLICATIONS

European Search Report issued in Application No. 18158930 dated Jul. 3, 2018.

*Primary Examiner* — Julian D Huffman
(74) *Attorney, Agent, or Firm* — Workman Nydegger

(57) ABSTRACT

A liquid ejecting apparatus includes a first tank that stores liquid to be supplied to a liquid ejecting head, a second tank that receives liquid that has not been ejected by the liquid ejecting head, a circulation path that circulates liquid. The second tank separately has a first opening that communicates with a second pressure adjusting unit that can depressurize the second tank and a second opening that communicates with a second atmosphere opening valve that switches the second tank between a sealed state and an atmosphere opening state. The second opening is arranged at a position lower than the first opening in a vertical direction.

13 Claims, 11 Drawing Sheets

LIQUID EJECTING APPARATUS

BACKGROUND

1. Technical Field

The present invention relates to a liquid ejecting apparatus.

2. Related Art

As a liquid ejecting apparatus, for example, an ink jet printing apparatus described in JP-A-2016-13648 is known. The ink jet apparatus employs an ink circulation system for an ink jet head and supplies ink from a main ink cartridge to a negative pressure side sub-tank by opening an ink supply valve. The amount of ink in the negative pressure side sub-tank is controlled by a liquid level sensor. Four negative pressure side sub-tanks are provided corresponding to four color inks. The four negative pressure side sub-tanks communicate with one negative pressure side common air chamber. The four negative pressure side sub-tanks are depressurized by an air pump through the negative pressure side common air chamber.

In the liquid ejecting apparatus described above, for example, when the ink supply valve or the liquid level sensor fails, ink may be excessively supplied to the negative pressure side sub-tank from an ink cartridge or the like. When depressurizing the negative pressure side sub-tank to which ink is excessively supplied, there is a risk that the ink is drawn into the air pump and the air pump fails. Further, in the negative pressure side sub-tank, there is a risk that color mixing of ink occurs.

SUMMARY

An advantage of some aspects of the invention is to provide a liquid ejecting apparatus that suppresses failures due to accidental leakage of liquid from the tank.

A liquid ejecting apparatus according to an aspect of the invention includes a liquid ejecting head that ejects liquid from nozzles, a recording unit having a first tank which is arranged at a position lower than the liquid ejecting head in a vertical direction and stores liquid to be supplied to the liquid ejecting head, a second tank which is arranged at a position lower than the liquid ejecting head in the vertical direction and receives liquid that has not been ejected by the liquid ejecting head, a circulation path that circulates liquid among the first tank, the liquid ejecting head, and the second tank, and a pump that sends liquid from the second tank to the first tank, a first atmosphere opening valve that switches the first tank between a sealed state and an atmosphere opening state, a second atmosphere opening valve that switches the second tank between a sealed state and an atmosphere opening state, a first pressure adjusting unit that can pressurize the first tank, and a second pressure adjusting unit that can depressurize the second tank. The second tank separately has a first opening that communicates with the second pressure adjusting unit and a second opening that communicates with the second atmosphere opening valve. The second opening is arranged at a position lower than the first opening in the vertical direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
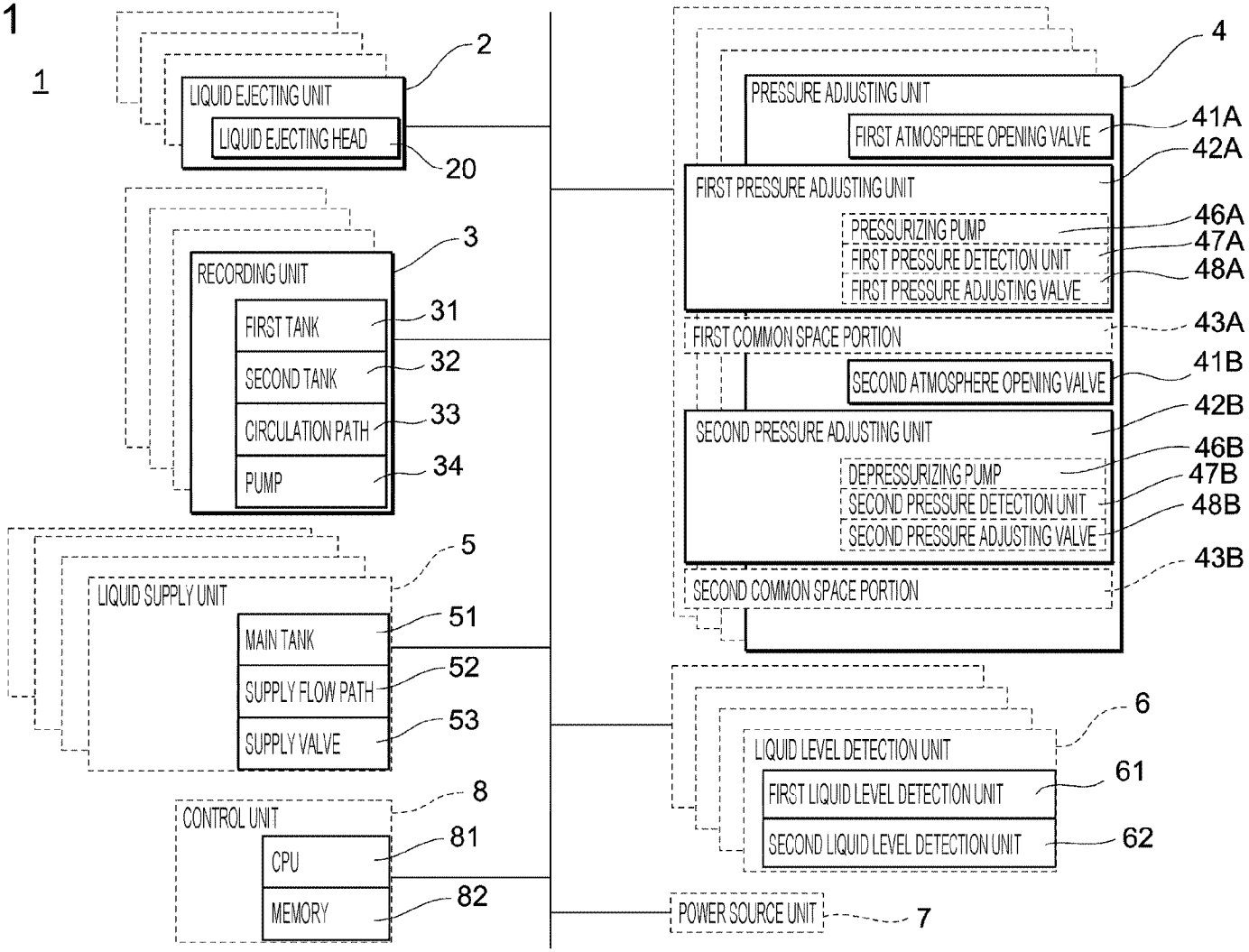
FIG. 1 is a block diagram showing an entire configuration of a liquid ejecting apparatus according to a first embodiment.

Preferred embodiments of the invention will be described with reference to the accompanying drawings. In the drawings, components denoted by the same reference numerals have the same or similar configurations.

First Embodiment

As shown in FIG. 1, a liquid ejecting apparatus 1 includes a liquid ejecting unit 2, a recording unit 3, a pressure adjusting unit 4, a liquid supply unit 5, a liquid level detection unit 6, a power source unit 7, and a control unit 8. There are one or more liquid ejecting units 2, recording units 3, pressure adjusting units 4, liquid supply units 5, and liquid level detection units 6. The numbers of these units can be changed according to the number and/or type of liquids used in the liquid ejecting apparatus 1. For example, when the liquid ejecting apparatus 1 is an ink jet printer that can perform color printing, inks of two or more colors such as four colors (black, cyan, magenta, and yellow) are used as the liquids. Two or more parts of the liquid ejecting unit 2, the recording unit 3, and the pressure adjusting unit 4, and two or more of the liquid supply units 5 and the liquid level detection units 6 are provided corresponding to the inks of two or more colors, respectively. The parts of the liquid ejecting unit 2, the recording unit 3, and the pressure adjusting unit 4, the liquid supply units 5, and the liquid level detection units 6 have the same configurations, respectively, except that the colors of inks to be used are different.

The liquid ejecting unit 2 includes one or more liquid ejecting heads 20. As shown in FIGS. 2 to 5, the liquid ejecting head 20 has nozzles 22 that eject liquid. Here, a direction in which the nozzles 22 face is a vertical downward direction. A plurality of nozzles 22 are provided for each liquid ejecting head 20. Inside the liquid ejecting head 20, there is a liquid chamber that stores liquid. The liquid chamber communicates with the nozzle 22. The liquid ejecting head 20 is driven by, for example, a piezo system, so that a predetermined amount of liquid is ejected from the nozzle 22 to a recording medium such as a printing paper.

The recording unit 3 has a first tank 31, a second tank 32, a circulation path 33, and a pump 34. As shown in FIGS. 2 to 5, the first tank 31 stores liquid to be supplied to the liquid ejecting head 20. In the first tank 31, a space, that is to say, a head space 31A, is formed above a liquid level of the stored liquid. The second tank 32 receives liquid that has not been ejected by the liquid ejecting head 20. In the second tank 32, a space, that is to say, a head space 32B, is formed above a liquid level of stored liquid. The second tank 32 is arranged at a position lower than the liquid ejecting head 20 in a vertical direction. The circulation path 33 is a path for circulating liquid among the first tank 31, the liquid ejecting head 20, and the second tank 32. Specifically, the circulation path 33 has a first flow path 33A that connects the first tank 31 and the liquid ejecting head 20, a second flow path 33B that connects the liquid ejecting head 20 and the second tank 32, and a third flow path 33C that connects the second tank 32 and the first tank 31. It is preferable that a flow path resistance of the first flow path 33A is greater than that of the second flow path 33B. This is because in this state, it is possible to apply an appropriate negative pressure to the nozzle 22. The pump 34 is to feed liquid from the second tank 32 to the first tank 31. The pump 34 is provided on the third flow path 33C of the circulation path 33. By the configuration as described above, the recording unit 3 employs a liquid circulation system for the liquid ejecting head 20.

The pressure adjusting unit 4 has a first atmosphere opening valve 41A, a first pressure adjusting unit 42A, a first common space portion 43A, a second atmosphere opening valve 41B, a second pressure adjusting unit 42B, and a second common space portion 43B. When one set of pressure adjusting units 4 are provided corresponding to one set of colors, one first common space portion 43A and one second common space portion 43B are provided for the one set of pressure adjusting units 4, and one first pressure adjusting unit 42A and one second pressure adjusting unit 42B are shared by the one set of pressure adjusting units 4.

The first atmosphere opening valve 41A switches the first tank 31 between a sealed state and an atmosphere opening state as shown in FIGS. 2 to 5. The first atmosphere opening valve 41A is arranged in the middle or at an end of a first atmosphere opening flow path 44A communicating with the head space 31A of the first tank 31. The first atmosphere opening valve 41A is composed of an electrically-controlled opening/closing valve such as, for example, an electromagnetic valve. When the first atmosphere opening flow path 44A is opened by the first atmosphere opening valve 41A, the head space 31A of the first tank 31 is opened to the atmosphere. The first atmosphere opening valve 41A can be formed into a structure replaceable with respect to the first atmosphere opening flow path 44A. By doing so, even when liquid attaches to the first atmosphere opening valve 41A, function can be restored by replacing the first atmosphere opening valve 41A. The first pressure adjusting unit 42A pressurizes the first tank 31. The first pressure adjusting unit 42A has, for example, a pressurizing pump and pressurizes the first tank 31 by sending compressed air to the head space 31A. The first common space portion 43A is provided when there is a plurality of recording units 3 and communicates with the head spaces 31A of the first tanks 31 of the plurality of recording units 3. The first common space portion 43A and the head space 31A of the first tank 31 of each of the plurality of recording units 3 are connected by a pipe 45A. When the first common space portion 43A is provided, the first pressure adjusting unit 42A pressurizes the first tanks 31 of the plurality of recording units 3 through the first common space portion 43A and the pipe 45A. When the first common space portion 43A is not provided, the pipe 45A connects the first pressure adjusting unit 42A and the head space 31A of the first tank 31.

Similarly, the second atmosphere opening valve 41B switches the second tank 32 between a sealed state and an atmosphere opening state as shown in FIGS. 2 to 5. The second atmosphere opening valve 41B is arranged in the middle or at an end of a second atmosphere opening flow path 44B communicating with the head space 31B of the second tank 32. The second atmosphere opening valve 41B is composed of an electrically-controlled opening/closing valve such as, for example, an electromagnetic valve. When the second atmosphere opening flow path 44B is opened by the second atmosphere opening valve 41B, the head space 32B of the second tank 32 is opened to the atmosphere. The second atmosphere opening valve 41B can be formed into a structure replaceable with respect to the second atmosphere opening flow path 44B. By doing so, even when liquid attaches to the second atmosphere opening valve 41B, function can be restored by replacing the second atmosphere opening valve 41B. The second pressure adjusting unit 42B depressurizes the second tank 32. The second pressure adjusting unit 42B has, for example, a depressurizing pump and depressurizes the second tank 32 by drawing air from the head space 32B. The second common space portion 43B is provided when there is a plurality of recording units 3 and communicates with the head spaces 32B of the second tanks 32 of the plurality of recording units 3. The second common space portion 43B and the head space 32B of the second tank 31 of each of the plurality of recording units 3 are connected by a pipe 45B. When the second common space portion 43B is provided, the second pressure adjusting unit 42B pressurizes the second tanks 32 of the plurality of recording units 3 through the second common space portion 43B and the pipe 45B. When the second common space portion 43B is not provided, the pipe 45B connects the second pressure adjusting unit 42B and the head space 32B of the second tank 32.

The liquid supply unit 5 has a main tank 51, a supply flow path 52, and a supply valve 53. As shown in FIGS. 2 to 5, the main tank 51 stores liquid. In detail, the main tank 51 stores uncirculated or new liquid to supply liquid to the liquid circulation system recording unit 3. The main tank 51 is arranged at a position higher than the second tank 32 in the vertical direction. The main tank 51 can be configured to be able to be replaced or be able to be injected with liquid. There may be a plurality of main tanks 51 per liquid or color. In this case, the main tank 51 that supplies liquid may be switched by an opening/closing valve. Thereby, even when liquid in one main tank 51 disappears, liquid can be continuously supplied from another main tank 51. Further, even while liquid is being supplied from the other main tank 51, the emptied main tank 51 can be replaced or can be injected with liquid. Therefore, it is possible to reduce down time. The supply flow path 52 communicates the main tank 51 with the second tank 32. The supply valve 53 opens and closes the supply flow path 52. When the supply valve 53 is opened, liquid is supplied from the main tank 51 to the second tank 32. The supply valve 53 is composed of an electrically-controlled opening/closing valve such as, for example, an electromagnetic valve.

The liquid level detection unit 6 has a first liquid level detection unit 61 and a second liquid level detection unit 62. As shown in FIGS. 2 to 5, the first liquid level detection unit 61 has a sensor that detects a liquid level height of the liquid in the first tank 31. The amount of liquid in the first tank 31 is managed by the first liquid level detection unit 61. Similarly, the second liquid level detection unit 62 has a sensor that detects a liquid level height of the liquid in the second tank 32. The amount of liquid in the second tank 32 is managed by the second liquid level detection unit 62. The power source unit 7 supplies electric power to each unit of the liquid ejecting apparatus 1. The electric power can be obtained from a battery or a commercial power source. The power source unit 7 switches ON/OFF of a main power source of the liquid ejecting apparatus 1 by a power source switch that can receive an operation of a user.

The control unit 8 is an electronic control unit including a CPU 81 and a memory 82. The control unit 8 is configured as, for example, a microcomputer. The CPU 81 executes a desired arithmetic operation according to a control program and performs various processing and controls. The memory 82 has, for example, a ROM and a RAM. The ROM stores a control program and control data to be processed by the CPU 81. The RAM is mainly used as various work areas for control processing. The control unit 8 receives input signals from various sensors such as the sensors of the liquid level detection unit 6, sends instruction signals to various devices (for example, the liquid ejecting head 20, the pump 34, the first atmosphere opening valve 41A, the second atmosphere opening valve 41B, the supply valve 53, and the like), and controls the entire liquid ejecting apparatus 1.

For example, the control unit 8 monitors the liquid level heights in the first tank 31 and the second tank 32 by using the first liquid level detection unit 61 and the second liquid level detection unit 62, and controls the pump 34, the supply valve 53, and the like so as to obtain appropriate heights of the liquid levels. When circulating liquid through the liquid ejecting head 20, such as when performing printing, it is controlled so that the first pressure adjusting unit 42A pressurizes the first tank 31 and the second pressure adjusting unit 42B depressurizes the second tank 32. When the first liquid level detection unit 61 detects that the liquid level in the first tank 31 falls, liquid is supplied from the second tank 32 to the first tank 31 by the pump 34. In this case, both the first atmosphere opening valve 41A and the second atmosphere opening valve 41B are in a closed state. On the other hand, when the second liquid level detection unit 62 detects that the liquid level in the second tank 32 falls, the supply valve 53 is opened, and liquid is supplied from the main tank 51 to the second tank 32.

When the main power source is OFF, both the supply valve 53 and the first atmosphere opening valve 41A are set to a closed state, but the second atmosphere opening valve 41B is set to an open state. Thereby, in a state of power source OFF, a state can be achieved where a negative pressure is applied to the nozzles 22 of the liquid ejecting head 20. These opening/closing valves (the first atmosphere opening valve 41A, the second atmosphere opening valve 41B, and the supply valve 53) may be configured to be the above states according to ON/OFF of the power source. Specifically, each of the first atmosphere opening valve 41A and the supply valve 53 may be a normal close type opening/closing valve which opens when a current is applied and closes when no current is applied, and the second atmosphere opening valve 41B may be a normal open type opening/closing valve which closes when a current is applied and opens when no current is applied. Thereby, the supply valve 53, which becomes a cause of a large amount of liquid flowing into the second tank 32 due to some trouble, is a normal close type valve, so that it is possible to suppress liquid overflow from the second tank 32 when the power source is OFF.

When the flow path resistance of the first flow path 33A is set to greater than that of the second flow path 33B in order to apply an appropriate negative pressure to eject liquid to the nozzles 22, the liquid may be circulated by opening both the first atmosphere opening valve 41A and the second atmosphere opening valve 41B.

Next, by sequentially referring to FIGS. 2 to 5, configurations of the first pressure adjusting unit 42A and the second pressure adjusting unit 42B, an arrangement of the first tank 31, and a configuration around the first tank 31 and the second tank 32, in each diagram will be described.

Figure 2:
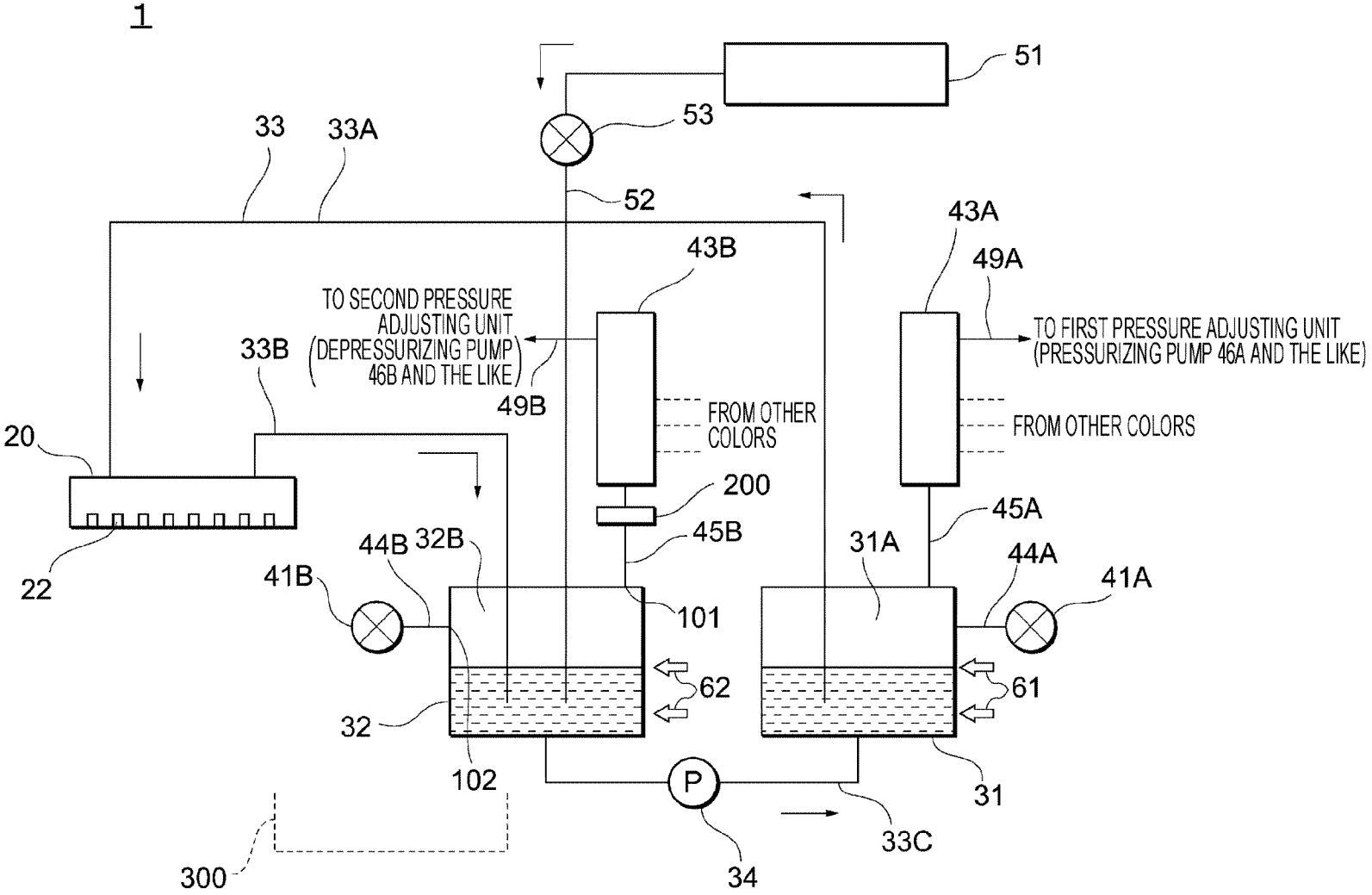
FIG. 2 is a diagram showing a first configuration example of the liquid ejecting apparatus of FIG. 1.

In a configuration example shown in FIG. 2, as shown in FIG. 1, the first pressure adjusting unit 42A has a pressurizing pump 46A that can pressurize the first tank 31, a first pressure detection unit 47A that detects pressure in the first tank 31, and a first pressure adjusting valve 48A that can open and close according to the pressure in the first tank 31. For example, the pressurizing pump 46A is provided on a pipe 49A communicating with the first common space portion 43A and communicates with the first tanks 31 of the plurality of recording units 3 through the first common space portion 43A. The pressurizing pump 46A sends compressed air to the plurality of head spaces 31A through the first common space portion 43A, so that the plurality of first tanks 31 are pressurized. The first pressure detection unit 47A is composed of, for example, a pressure sensor that detects pressure in the first common space portion 43A or the pipe 49A. A value detected by the first pressure detection unit 47A reflects a pressure value in the head space 31A of the first tank 31. The first pressure adjusting valve 48A is provided in, for example, the pipe 49A. The first pressure adjusting valve 48A adjusts the pressure of the head space 31A through the first common space portion 43A by opening and closing the pipe 49A according to the pressure value detected by the first pressure detection unit 47A. As described above, when there is only one recording unit 3, the first common space portion 43A is not provided. In this case, for example, the pressurizing pump 46A and the first pressure adjusting valve 48A are provided in the pipe 45A, and the first pressure detection unit 47A can be provided so as to detect pressure in the pipe 45A or the head space 31A.

Similarly, the second pressure adjusting unit 42B has a depressurizing pump 46B that can depressurize the second tank 32, a second pressure detection unit 47B that detects pressure in the second tank 32, and a second pressure adjusting valve 48B that can open and close according to the pressure in the second tank 32. For example, the depressurizing pump 46B is provided on a pipe 49B communicating with the second common space portion 43B and communicates with the second tanks 32 of the plurality of recording units 3 through the second common space portion 43B. The depressurizing pump 46B draws air from the plurality of head spaces 32B through the second common space portion 43B, so that the plurality of second tanks 32 are depressurized. The second pressure detection unit 47B is composed of, for example, a pressure sensor that detects pressure in the second common space portion 43B or the pipe 49B. A value detected by the second pressure detection unit 47B reflects a pressure value in the head space 32B of the second tank 32. The second pressure adjusting valve 48B is provided in, for example, the pipe 49B. The second pressure adjusting valve 48B adjusts the pressure of the head space 32B through the second common space portion 43B by opening and closing the pipe 49B according to the pressure value detected by the second pressure detection unit 47B. As described above, when there is only one recording unit 3, the second common space portion 43B is not provided. In this case, for example, the depressurizing pump 46B and the second pressure adjusting valve 48B are provided in the pipe 45B, and the second pressure detection unit 47B can be provided so as to detect pressure in the pipe 45B or the head space 32B.

As described above, the first pressure adjusting unit 42A has the first pressure detection unit 47A and the first pressure adjusting valve 48A, and the second pressure adjusting unit 42B has the second pressure detection unit 47B and the second pressure adjusting valve 48B, so that it is possible to perform accurate pressure adjustment on the first tank 31 and the second tank 32. Thereby, for example, it is possible to stabilize pressure in the liquid ejecting head 20 when ejecting liquid, so that it is possible to stabilize quality of liquid ejection, such as quality of printing. Regarding the above devices (46A, 47A, and 48A) included in the first pressure adjusting unit 42A, each of the devices may be individually connected to the first tank 31, or all the devices may be connected to the first common space portion 43A. Similarly, regarding the above devices (46B, 47B, and 48B) included in the second pressure adjusting unit 42B, each of the devices may be individually connected to the second tank 32, or all the devices may be connected to the second common space portion 43B. In other words, a layout according to specifications of the liquid ejecting apparatus 1 can be employed for the first pressure adjusting unit 42A and the second pressure adjusting unit 42B.

The first tank 31 is arranged at a position lower than the liquid ejecting head 20 in the vertical direction. The first tank 31 is arranged at the same height position as that of the second tank 32. The second tank 32 has a first opening 101 and a second opening 102 arranged at a position lower than the first opening 101 in the vertical direction. The first opening 101 communicates the head space 32B of the second tank 32 with the second pressure adjusting unit 42B through the pipe 45B or through the pipe 45B and the second common space portion 43B. The first opening 101 is formed, for example, in an upper surface of the second tank 32. The second opening 102 communicates the head space 32B of the second tank 32 with the second atmosphere opening valve 41B through the second atmosphere opening flow path 44B. The second opening 102 is formed, for example, in a side surface of the second tank 32.

If an over supply of liquid to the second tank 32 occurs due to a meniscus destruction of the nozzle 22 caused by vibration or the like or due to a failure or the like of the liquid ejecting apparatus 1 caused by open failure or the like of the supply valve 53, the head space 32B of the second tank 32 is gradually reduced from the bottom. At this time, in the second tank 32, the over-supplied liquid reaches the second opening 102 before reaching the first opening 101. Thereby, it is possible to cause the over-supplied liquid to overflow from the second atmosphere opening valve 41B to the outside through the second opening 102, so that it is possible to prevent the over-supplied liquid from reaching the second pressure adjusting unit 42B. Therefore, it is possible to reduce failure of the second pressure adjusting unit 42B (for example, failure of the depressurizing pump 46B) when an over supply of liquid to the second tank 32 occurs.

In this configuration example, it is preferable that the head space 32B of the second tank 32 is larger than the volume of the second flow path 33B. Specifically, it is preferable that the volume of the head space 32B at normal time when no over supply of liquid to the second tank 32 occurs is larger than the volume of the second flow path 33B. This is because when a meniscus destruction of the nozzle 22 occurs from any cause, the liquid in the second flow path 33B flows into the second tank 32, however, all the liquid flowing into the second tank 32 can be stored in the second tank 32. Thereby, it is possible to suppress liquid overflow from the second tank 32. In this case, it is more preferable that the second opening 102 is arranged at a position where liquid does not touch the second opening 102 even when all the liquid in the second flow path 33B flows into the second tank 32.

Also in the first tank 31, in the same manner as in the second tank 32, an opening that communicates with the first atmosphere opening flow path 44A can be arranged at a position lower than an opening that communicates with the first pressure adjusting unit 42A in the vertical direction.

Figure 3:
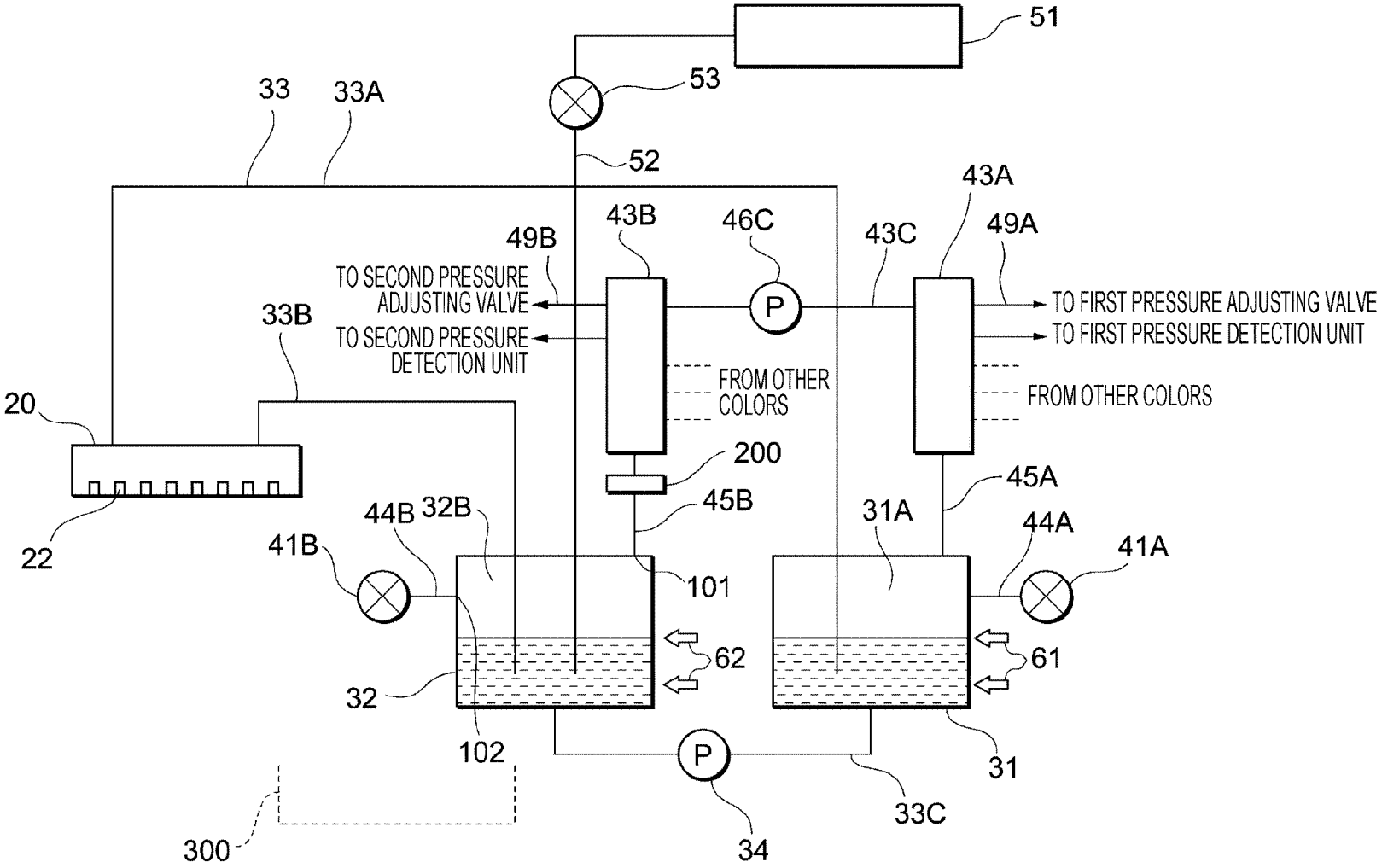
FIG. 3 is a diagram showing a second configuration example of the liquid ejecting apparatus of FIG. 1.

A configuration example shown in FIG. 3 is a modified example of the configuration example shown in FIG. 2. Here, descriptions of items common to the configuration example shown in FIG. 2 are omitted, and only differences will be described. In the configuration example shown in FIG. 3, the pressurizing pump 46A and the depressurizing pump 46B in the configuration example of FIG. 2 are configured as a common air pump 46C that sends air from the second tank 32 to the first tank 31. The air pump 46C is provided on a pipe 43C that connects the second common space portion 43B and the first common space portion 43A. The air pump 46C depressurizes the second tank 32 and pressurizes the first tank 31 by sending air from the second tank 32 to the first tank 31 through the second common space portion 43B and the first common space portion 43A.

According to this configuration example, one air pump 46C substitutes for the pressurizing pump 46A and the depressurizing pump 46B, so that it is possible to reduce cost and simplify apparatus configuration. When the first common space portion 43A and the second common space portion 43B are not provided, the air pump 46C may be provided to a pipe that connects the pipe 45B and the pipe 45A.

Figure 4:
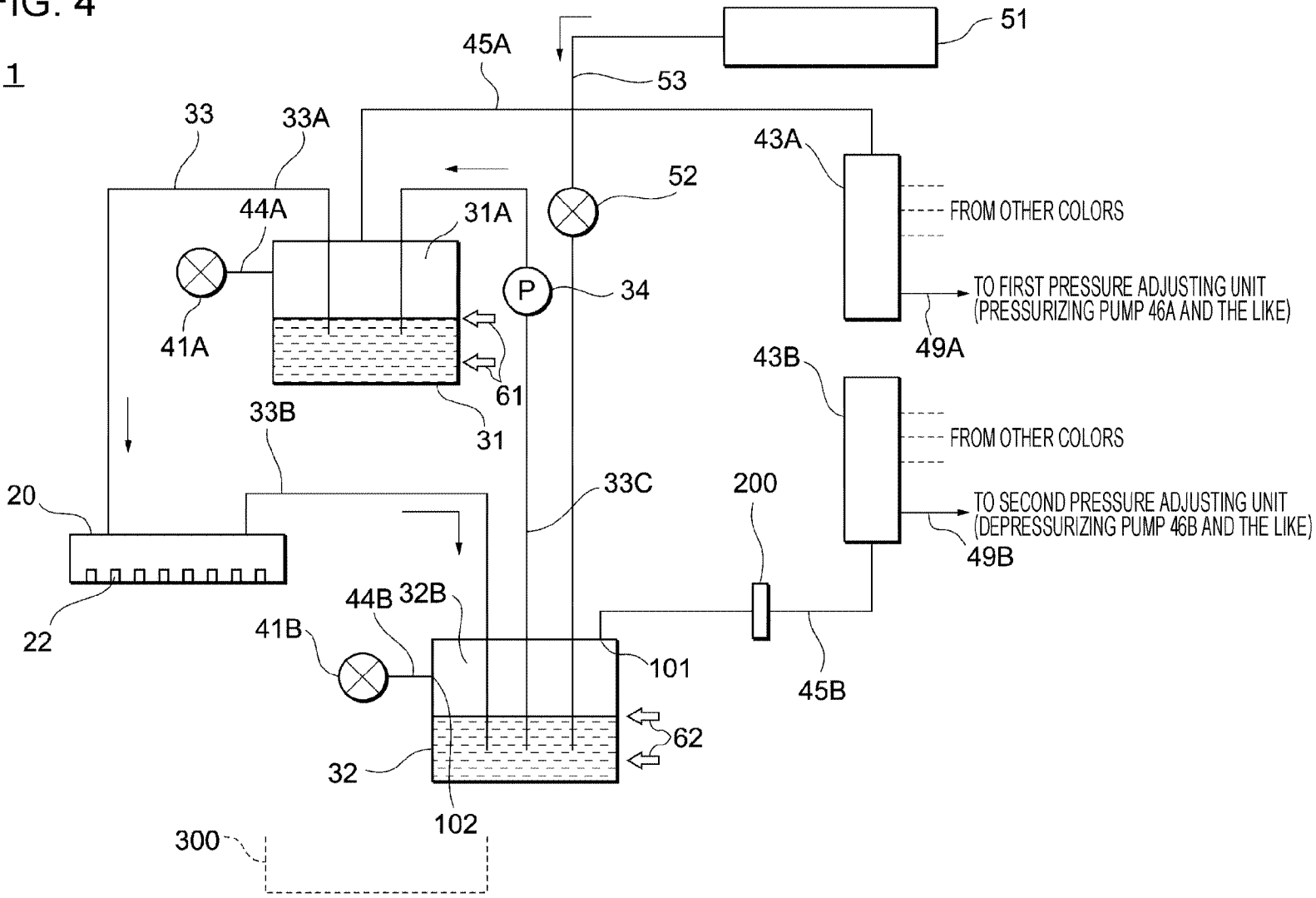
FIG. 4 is a diagram showing a third configuration example of the liquid ejecting apparatus of FIG. 1.

A configuration example shown in FIG. 4 is a modified example of the configuration example shown in FIG. 2. Here, descriptions of items common to the configuration example shown in FIG. 2 are omitted, and only differences will be described. In the configuration example shown in FIG. 4, the first tank 31 is arranged at a position higher than the liquid ejecting head 20 in the vertical direction. Also by the configuration example shown in FIG. 4, it is possible to achieve functions and effects similar to those of the configuration example shown in FIG. 2.

Figure 5:
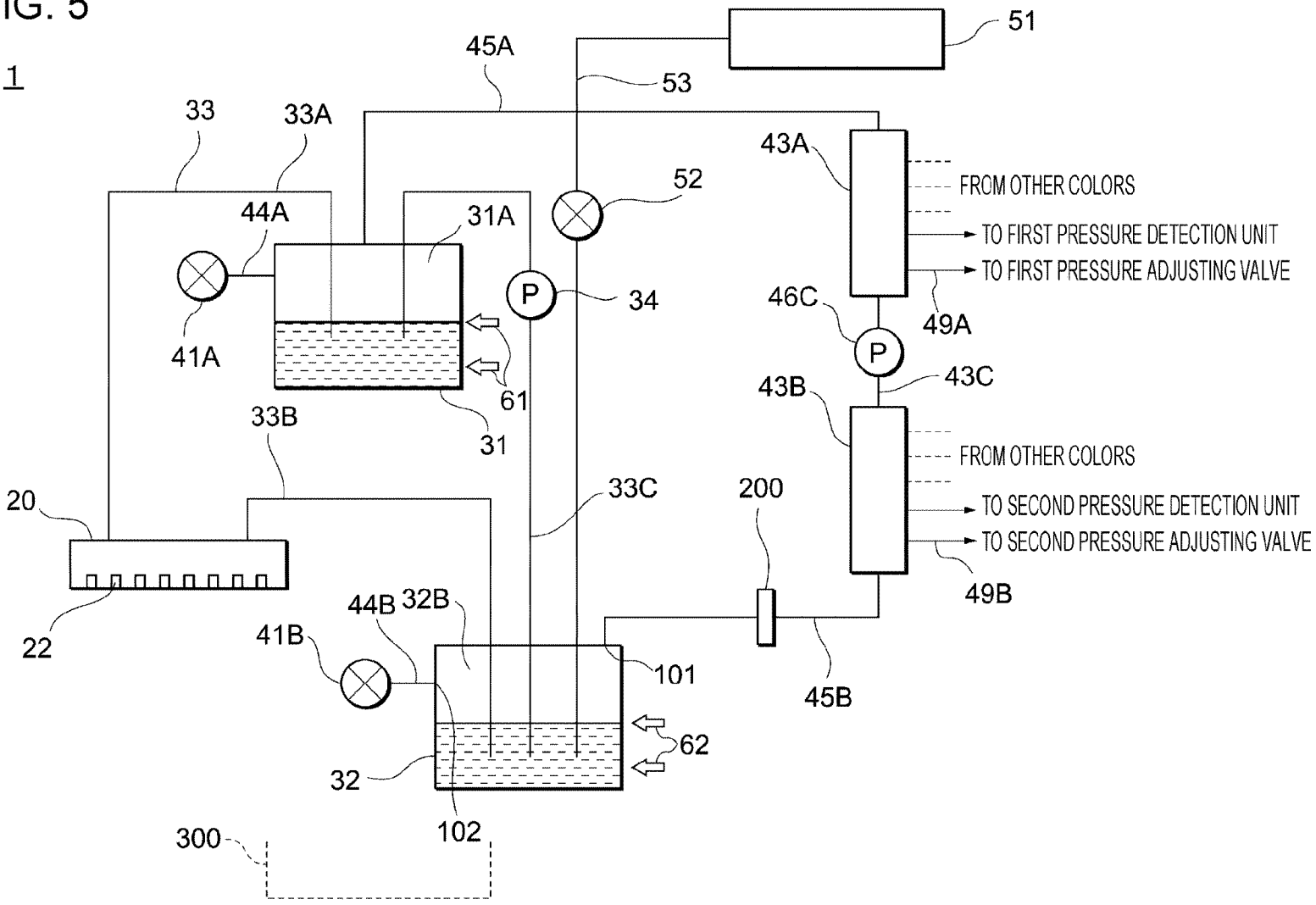
FIG. 5 is a diagram showing a fourth configuration example of the liquid ejecting apparatus of FIG. 1.

A configuration example shown in FIG. 5 is a modified example of the configuration example shown in FIG. 4. Here, descriptions of items common to the configuration example shown in FIG. 4 are omitted, and only differences will be described. In the configuration example shown in FIG. 5, in the same manner as in the configuration example shown in FIG. 3, the pressurizing pump 46A and the depressurizing pump 46B in the configuration example of FIG. 4 are configured as the common air pump 46C that sends air from the second tank 32 to the first tank 31. Therefore, according to the configuration example shown in FIG. 5, in the same manner as in the configuration example shown in FIG. 3, it is possible to reduce cost and simplify apparatus configuration.

Next, a gas-liquid separator 200 will be described with reference to FIGS. 2 to 5. The liquid ejecting apparatus 1 may include the gas-liquid separator 200 provided between the first opening 101 and the second pressure adjusting unit 42B. Here, the gas-liquid separator 200 is provided on the pipe 45B. According to such a configuration, even if liquid reaches the first opening 101, it is possible for the gas-liquid separator 200 to prevent the liquid from reaching the second pressure adjusting unit 42B. Thereby, it is possible to further restrain the liquid from flowing into the second pressure adjusting unit 42B.

The gas-liquid separator 200 can be composed of a gas-liquid separation membrane formed of, for example, a material that passes air but does not pass liquid (for example, Gore-Tex or the like). The gas-liquid separator 200 can be configured to be replaceably attached to the pipe 45B. By doing so, even when overflowing liquid attaches to the gas-liquid separator 200, function can be restored by replacing the gas-liquid separator 200. The same gas-liquid separator as the gas-liquid separator 200 may be provided between the first pressure adjusting unit 42A and an opening through which the first tank 31 communicates with the first pressure adjusting unit 42A. In addition, it is preferable that the gas-liquid separator 200 is provided closer to the second tank 32 than a joining portion where flow paths of a plurality of colors join (the second common space portion 43B described above). This is because even when the liquid overflows from the second tank 32 to the second pressure adjusting unit 42B, it is possible to prevent a color from being mixed with another color. In this regard, it is also preferable that the gas-liquid separator for the first tank 31 is provided closer to the first tank 31 than a joining portion where flow paths of a plurality of colors join (the first common space portion 43A described above).

When the gas-liquid separator 200 is provided, the first opening 101 may be arranged at the same height as the second opening 102 in the vertical direction or may be arranged lower than the second opening 102 in the vertical direction. The liquid is prevented from flowing toward the second pressure adjusting unit 42B by the gas-liquid separator 200, so that it is possible to freely determine a structure of the second tank 32. In other words, it is possible to enhance design flexibility of the second tank 32.

Next, a liquid receiving portion 300 will be described with reference to FIGS. 2 to 5. The liquid ejecting apparatus 1 includes the liquid receiving portion 300 that can receive liquid overflowing from the second tank 32. The liquid receiving portion 300 may have a configuration that receives liquid overflowing from the second tank 32. For example, the liquid receiving portion 300 can be configured by a tray-type liquid-proof pan. The liquid can be restrained from leaking to the outside of the apparatus by the liquid receiving portion 300.

As shown in FIGS. 2 to 5, when the second atmosphere opening valve 41B is provided at an end portion of the second atmosphere opening flow path 44B, it is preferable that the liquid receiving portion 300 is arranged below the second atmosphere opening valve 41B. On the other hand, when the second atmosphere opening valve 41B is provided in the middle of the second atmosphere opening flow path 44B, it is preferable that the liquid receiving portion 300 is arranged below the end portion of the second atmosphere opening flow path 44B. Alternatively, the end portion of the second atmosphere opening flow path 44B may communicate with the liquid receiving portion 300. According to such a configuration, the liquid receiving portion 300 can receive liquid that overflows from the second tank 32 and passes through the second atmosphere opening valve 41B.

When a waste liquid storage portion for storing waste liquid is provided in the liquid ejecting apparatus 1, a flow path communicating the liquid receiving portion 300 with the waste liquid storage portion may be provided, and the liquid received by the liquid receiving portion 300 may be guided to the waste liquid storage portion. According to this configuration, it is possible to restrain overflowing liquid from leaking to the outside of the apparatus. Further, in the case of this configuration, a liquid sensor may be provided in the flow path. In other words, the liquid overflowing from the liquid receiving portion 300 may pass through the liquid sensor and then flow into the waste liquid storage portion. According to this configuration, when the power source is OFF, liquid is prevented from leaking to the outside of the apparatus by storing a large amount of liquid in the waste liquid storage portion. On the other hand, when the power source is ON, liquid leakage can be detected by the liquid sensor, so that it is possible to prompt a user to perform maintenance.

A liquid sensor may be provided to the liquid receiving portion 300. When the liquid sensor detects liquid, it is determined that an error occurs, and as a result, supply of liquid to the liquid ejecting head 20 and the like may be stopped. In this case, a user may be notified accordingly. It is possible to restrain overflowing liquid from leaking to the outside of the apparatus by using such a liquid sensor.

The liquid receiving portion 300 and the configuration related to the liquid receiving portion 300 may be provided on the side of the first tank 31. By doing so, it is possible to receive liquid overflowing from the first tank 31. The liquid receiving portion on the side of the first tank 31 and the liquid receiving portion 300 on the side of the second tank 32 may be portions different from each other or may be a portion common to both sides.

Second Embodiment

In the second embodiment, descriptions of items common to the first embodiment are omitted, and only differences will be described.

Figure 6:
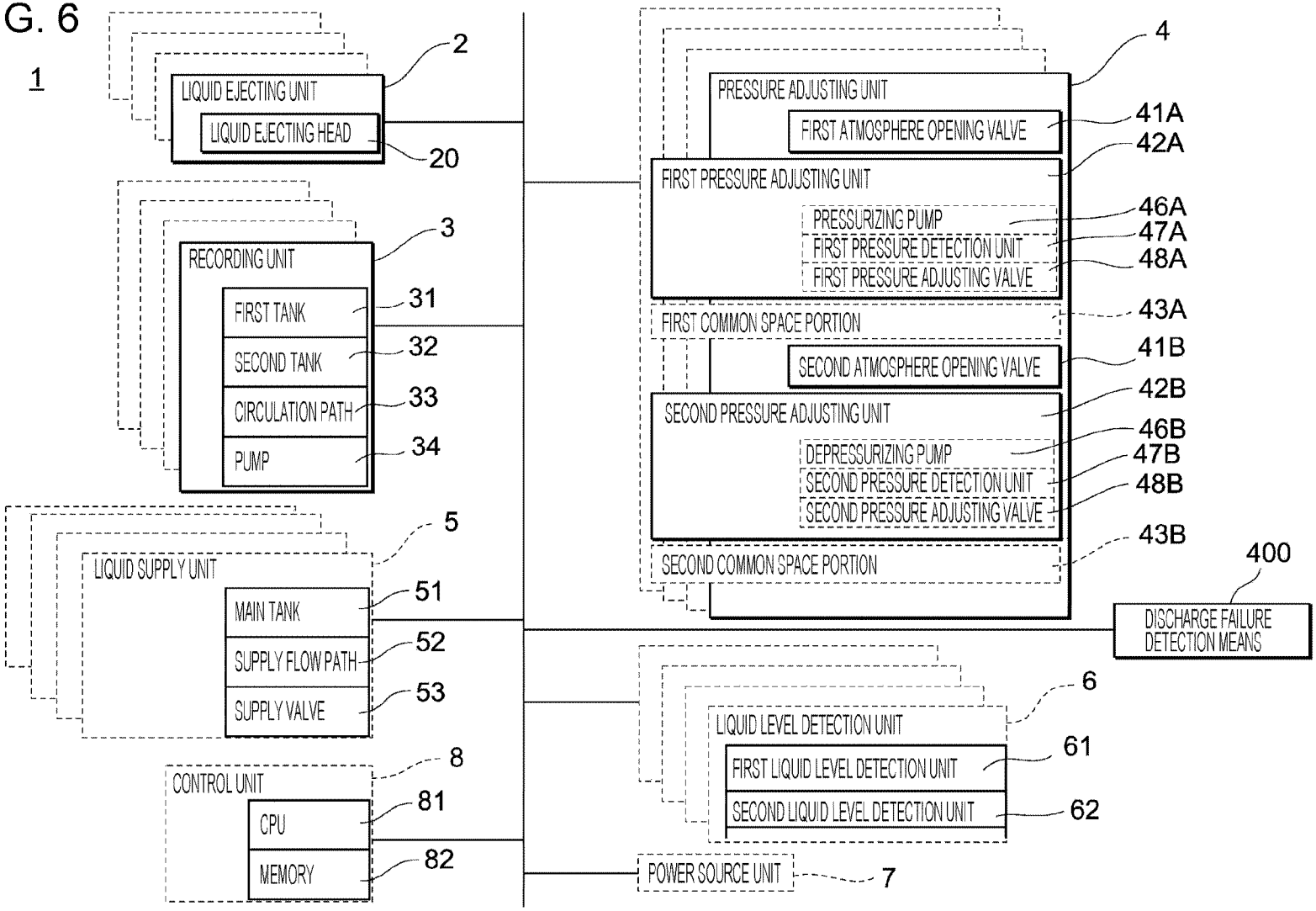
FIG. 6 is a block diagram showing an entire configuration of a liquid ejecting apparatus according to a second embodiment.

As shown in FIG. 6, as compared with the first embodiment, the liquid ejecting apparatus 1 includes a discharge failure detection means 400. The discharge failure detection means 400 detects discharge failures of the nozzles 22. The discharge failure detection means 400 can employ various detection methods. For example, the discharge failure detection means 400 can employ a method that acquires residual vibration information of a liquid chamber in the liquid ejecting head 20. As an example, regarding the liquid ejecting head 20 having piezoelectric elements, the discharge failure detection means 400 outputs a drive signal that changes a volume of the liquid chamber within a range where liquid is not ejected from the nozzle 22 to a piezoelectric element. On the other hand, the discharge failure detection means 400 acquires the residual vibration information of the liquid chamber detected by the piezoelectric element. Thereby, the discharge failure detection means 400 can inspect a liquid ejection state for each nozzle. A detection result acquired by the discharge failure detection means 400 is outputted to the control unit 8, and the control unit 8 controls devices in the pressure adjusting unit 4 on the basis of the detection result.

Figure 7:
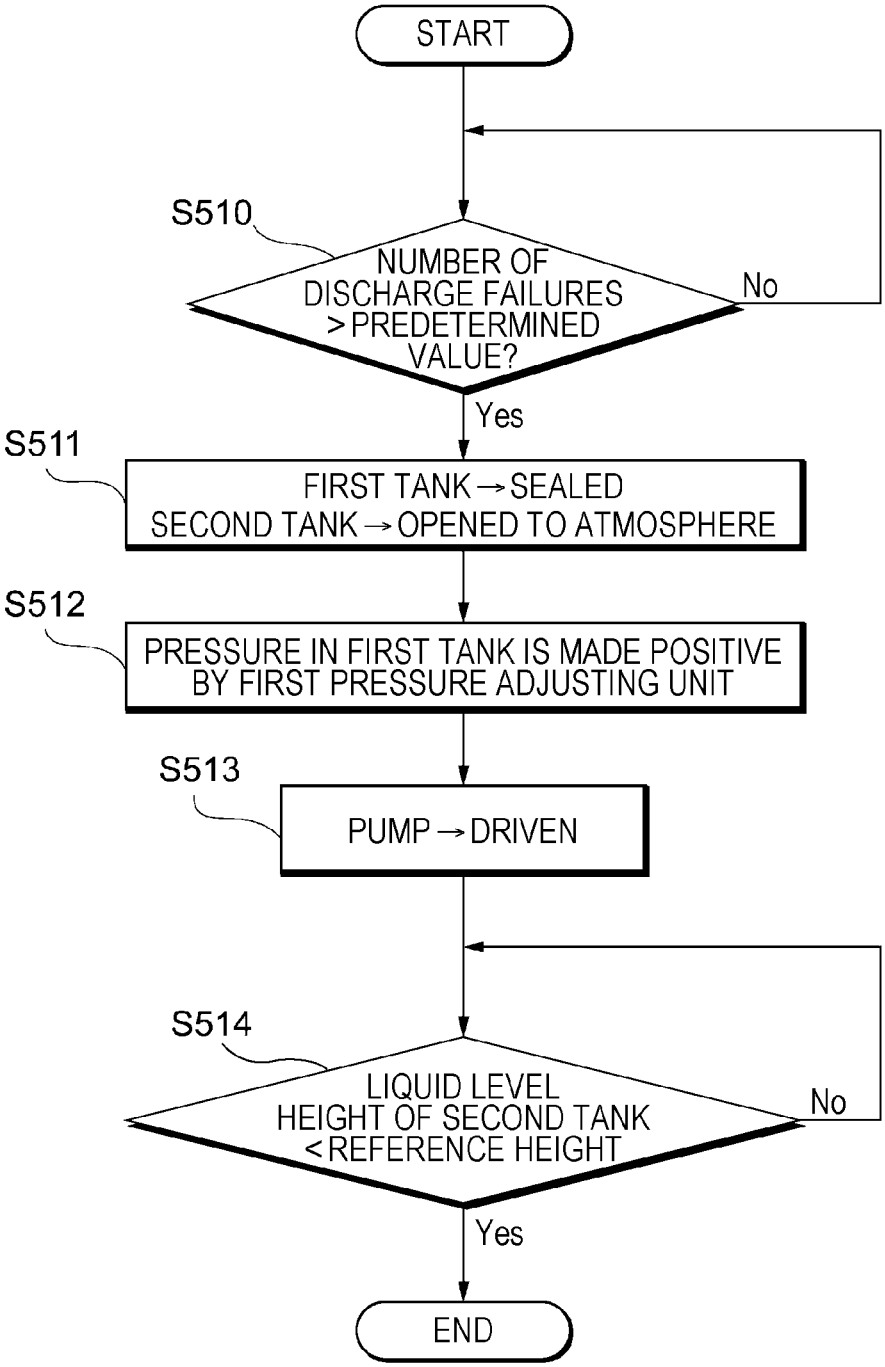
FIG. 7 is a flowchart showing a process executed by the liquid ejecting apparatus of FIG. 6.

Specifically, as shown in FIG. 7, when the discharge failure detection means 400 detects discharge failures of a predetermined number of nozzles 22 (step S510: Yes), first, the first tank 31 is sealed by the first atmosphere opening valve 41A and the second tank 32 is opened to the atmosphere by the second atmosphere opening valve 41B (step S511). Here, it can be assumed that "discharge failures of a predetermined number of nozzles 22" is, for example, a case in which half of a plurality of nozzles 22 in the liquid ejecting head 20 are with discharge failures. In this case, it is highly probable that the liquid in the second flow path 33B flows into the second tank 32 from the nozzles 22 with discharge failures.

Next, in the above state, the pressure in the first tank 31 is made positive by the first pressure adjusting unit 42A, and thereby the liquid is sent from the first tank 31 to the liquid ejecting head 20 (step S512). This can be performed by driving the pressurizing pump 46A or the air pump 46C. Further, in the above state, the liquid is sent from the second tank 32 to the first tank 31 by driving the pump 34 until the liquid level height of the second tank 32 becomes lower than a reference height (step S513). The liquid level height of the second tank 32 is detected by the second liquid level detection unit 62. The "reference height" can be, for example, an upper limit value of the liquid level height allowed in normal times. When the liquid level height of the second tank 32 becomes lower than the reference height (step S514: Yes), a series of controls is completed, and the control of the devices of the pressure adjusting unit 4 is restored to the control at normal times. For example, the first atmosphere opening valve 41A is opened and the second atmosphere opening valve 41B is closed.

In this way, the discharge failure detection means 400 detects that the meniscus of the nozzle 22 is broken, and thereby it is possible to recognize that the liquid returns to the second tank 32 from the liquid ejecting head 20 and reduce the amount of liquid in the second tank 32 before the second pressure adjusting unit 42B depressurizes the second tank 32. When the nozzle 22 is in a normal state, the above operation is not performed, so that it is possible to shorten maintenance time.

Modified Example: Around Second Tank

Next, a modified example around the second tank 32 will be described with reference to FIGS. 8 to 10B. In the modified example, descriptions of items common to the configuration described above are omitted, and only differences will be described.

Figure 8:
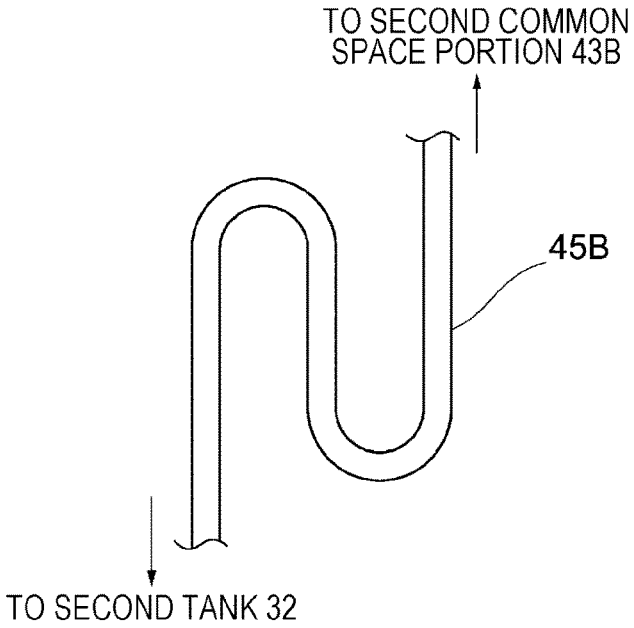
FIG. 8 is a diagram showing a shape of a pipe as a configuration around a second tank according to a modified example.

FIG. 8 shows a shape of the pipe 45B from the second tank 32 to the second common space portion 43B. The pipe 45B is bent into S shape. By employing such a configuration, even when liquid flows into the pipe 45B, it can be made difficult for the liquid to reach the second common space portion 43B or the second pressure adjusting unit 42B. In order to achieve such an effect, the flow path structure of the pipe 45B may be, for example, a tubular structure extending upward instead of the S shape. Alternatively, the flow path structure of the pipe 45B may be a structure having an inclination angle of 45° or more.

Water repellent finishing may be applied to the inside of the pipe 45B. In this case, the water repellent finishing may be applied to only the inside surface near the second tank 32 in the pipe 45B. By applying the water repellent finishing, even when liquid attaches to the pipe 45B, the attached liquid can be easily returned to the second tank 32. It is possible to apply the water repellent finishing to areas around the first opening 101.

Figure 9:
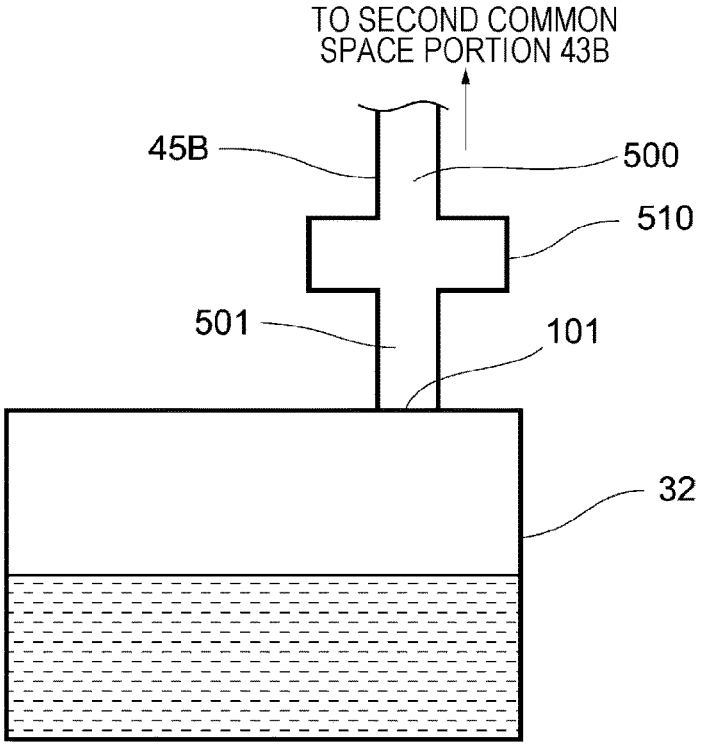
FIG. 9 is a diagram showing a liquid capturing portion as a configuration around the second tank according to a modified example.

FIG. 9 shows an example in which a liquid capturing portion 510 is provided to a space part 500 that connects the second tank 32 with the second common space portion 43B. The liquid capturing portion 510 has the same function as that of the gas-liquid separator 200 in a point that the liquid capturing portion 510 captures liquid in the pipe 45B. A point where the liquid capturing portion 510 is structurally different from the gas-liquid separator 200 is that the liquid capturing portion 510 is formed by enlarging an area of a part of the space part 500. The space part 500 has a flow path (the pipe 45B) 501 from the second tank 32 to the second common space portion 43B and the first opening 101 formed at one end of the flow path 501. Here, the liquid capturing portion 510 is provided as a widened portion in the middle of the flow path 501. Specifically, the liquid capturing portion 510 is formed by enlarging a pipe diameter of a portion in the middle of the pipe 45B to be larger than the other portions. By employing such a configuration, even when the liquid flows into the pipe 45B, a meniscus (liquid film) easily stops at the liquid capturing portion 510. Therefore, even when the second pressure adjusting unit 42B depressurizes the second tank 32, the liquid is difficult to be sucked to the second common space portion 43B.

Figure 10A:
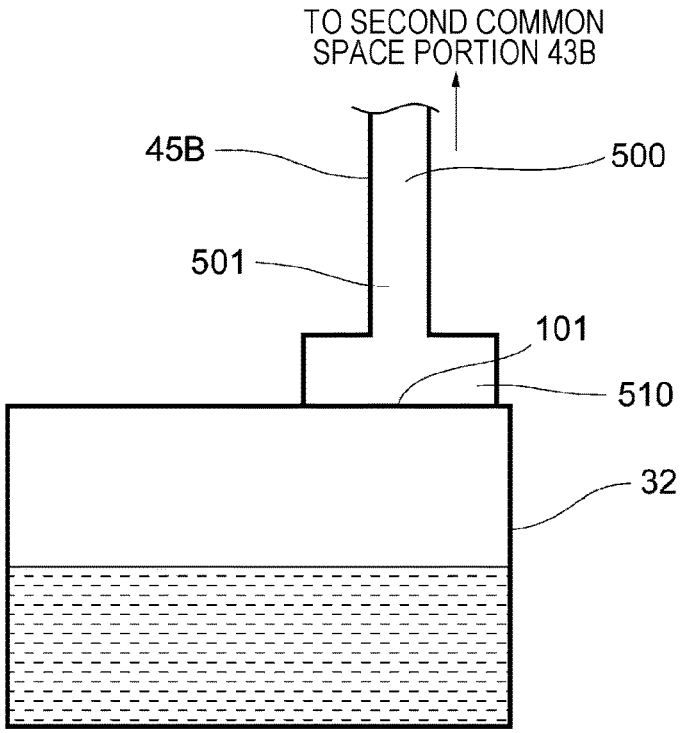
FIG. 10A is a diagram showing another example of the liquid capturing portion.
Figure 10B:
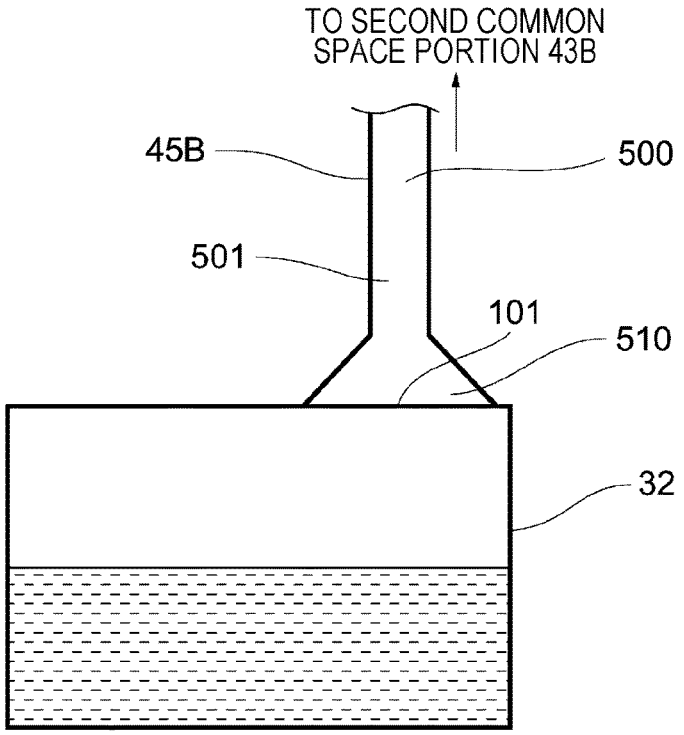
FIG. 10B is a diagram showing yet another example of the liquid capturing portion.

FIGS. 10A and 10B show other examples of the liquid capturing portion 510. As shown in FIG. 10A, the opening area of the first opening 101 is larger than the cross-sectional area of the flow path 501. In this case, as shown in FIG. 10B, the first opening 101 may be formed into a tapered shape toward the pipe 45B. A portion whose opening area is large in the first opening 101 functions as the liquid capturing portion 510. In other words, the liquid capturing portion 510 is formed by enlarging at least a part of the opening area of the first opening 101 to be larger than the cross-sectional area of the flow path 501. By employing such a configuration, it is possible to make it difficult for the meniscus (liquid film) to be formed in the liquid capturing portion 510. Thereby, even when the second pressure adjusting unit 42B depressurizes the second tank 32, the liquid is difficult to be sucked to the second common space portion 43B.

Modified Example: Second Common Space Portion 43B

Next, a modified example of the second common space portion 43B will be described with reference to FIGS. 11 and 12. In the modified example, descriptions of items common to the configuration described above are omitted, and only differences will be described.

Figure 11:
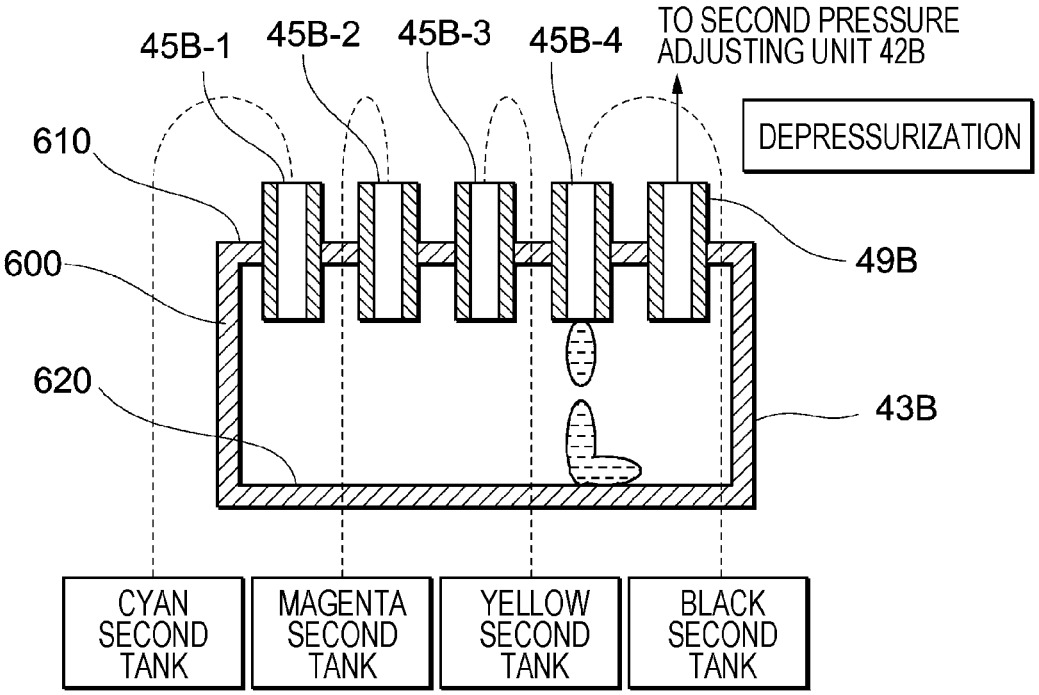
FIG. 11 is a diagram showing a second common space portion according to a modified example.

FIG. 11 schematically shows a cross-sectional view of the second common space portion 43B to which four pipes 45B-1, 45B-2, 45B-3, and 45B-4 and one pipe 49B are connected. Here, four color inks (cyan, magenta, yellow, and black) are used as liquids, and the four pipes 45B-1, 45B-2, 45B-3, and 45B-4 from four second tanks 32 are provided corresponding to the four color inks, respectively. The pipe 49B is connected to the second pressure adjusting unit 42B. The second common space portion 43B has a housing 600 having a space inside thereof, and the five pipes (45B-1, 45B-2, 45B-3, 45B-4, and 49B) are connected to an upper portion 610 of the housing 600. By such a configuration, for example, even when the black ink flows from the pipe 45B-4 to the second common space portion 43B, the black ink drops to a bottom portion 620 of the housing 600. Thereby, it is possible to restrain the black ink from flowing from the pipe 45B-4 into the second tanks 32 of the other colors through the pipes 45B-1, 45B-2, and 45B-3 and also restrain the black ink from flowing into the second pressure adjusting unit 42B through the pipe 49B.

Figure 12:
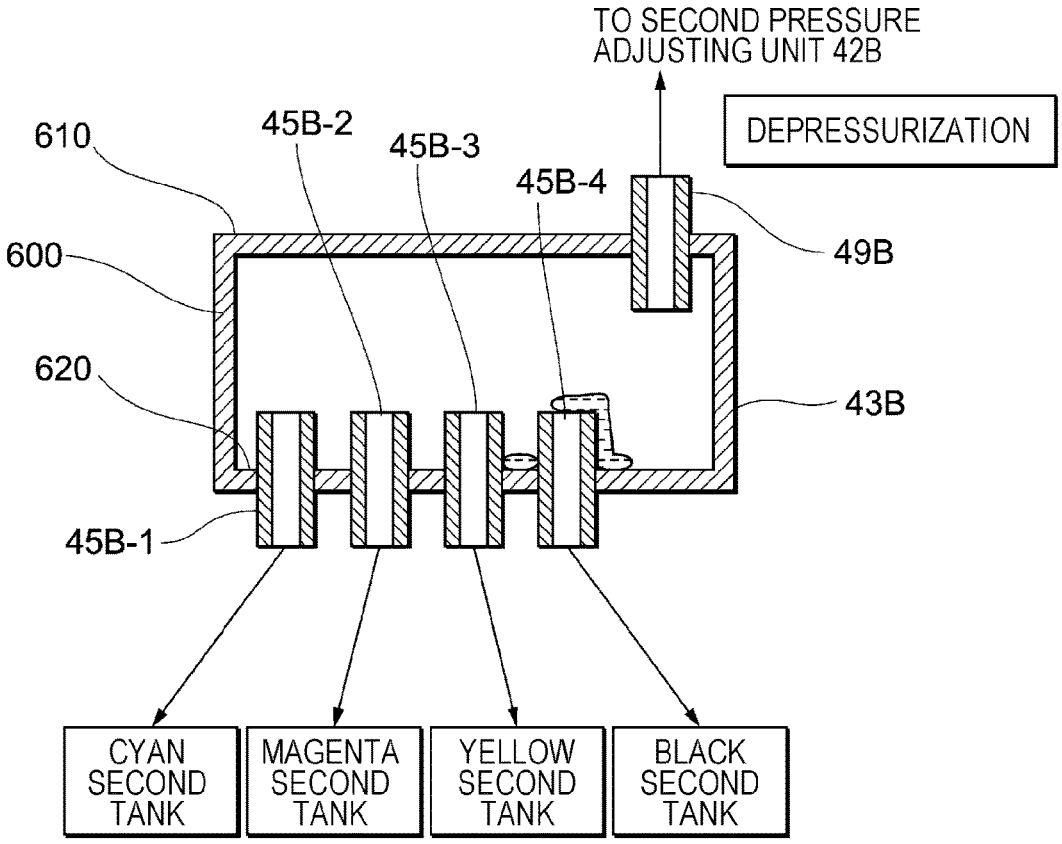
FIG. 12 is a diagram showing a second common space portion according to another modified example.

FIG. 12 shows another modified example of the second common space portion 43B. A point different from the modified example of FIG. 11 is that the four pipes 45B-1, 45B-2, 45B-3, and 45B-4 are connected to the bottom portion 620 of the housing 600 and protruded from the bottom portion 620 to the space inside the housing 600. Also by such a configuration, in the same manner as in the modified example of FIG. 11, for example, even when the black ink flows from the pipe 45B-4 to the second common space portion 43B, it is possible to restrain the black ink from flowing from the pipe 45B-4 into the second tanks 32 of the other colors through the pipes 45B-1, 45B-2, and 45B-3 and also restrain the black ink from flowing into the second pressure adjusting unit 42B.

About Flow Path Resistance

Next, the flow path resistance will be described with reference to FIG. 13. Here, descriptions of items common to the configuration described above are omitted, and only differences will be described.

Figure 13:
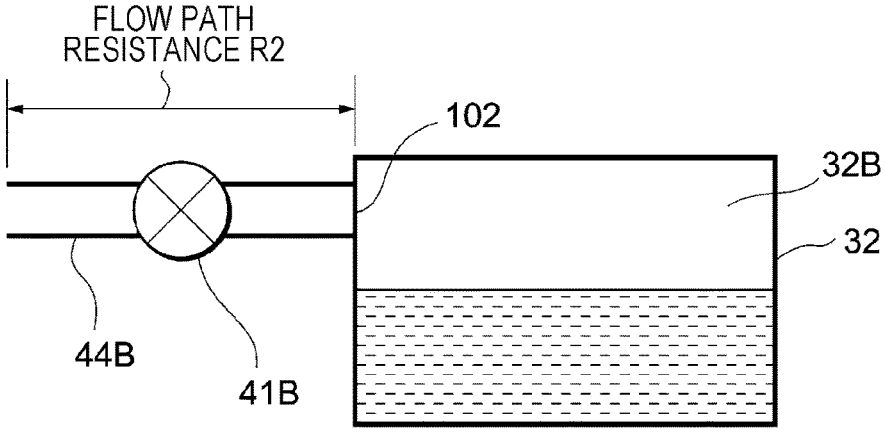
FIG. 13 is a diagram schematically showing a second atmosphere opening valve, a second atmosphere opening flow path, and a second tank for explaining a flow path resistance.

FIG. 13 shows an example in which the second atmosphere opening valve 41B is arranged in the middle of the second atmosphere opening flow path 44B. One end portion of the second atmosphere opening flow path 44B communicates with the second opening 102 of the second tank 32, and the other end portion communicates with the outside (atmosphere). It is preferable that the flow path resistances of potions in the liquid ejecting apparatus 1 are set as shown by the formula (1).

$$R1>R2 \quad (1)$$

Here, referring also to FIGS. 2 to 5, R1 is the flow path resistance from the main tank 51 to the second tank 32. R2 is the flow path resistance from the second opening 102 to the other end portion of the second atmosphere opening flow path 44B.

Further, it is preferable to set as shown by the formula (2).

$$R3>R2 \quad (2)$$

Here, referring also to FIGS. 2 to 5, R3 is the flow path resistance from the first opening 101 to the second common space portion 43B.

Further, it is possible to set as shown by the formula (3).

$$R1>R3>R2 \quad (3)$$

In this way, among the flow paths connected to the second tank 32, the flow path resistance of the flow path including the second atmosphere opening valve 41B is smaller than those of the other flow paths. Thereby, when the liquid leaks from the second tank 32, it is possible to cause the liquid to easily flow toward the second atmosphere opening valve 41B.

The embodiments and the modified examples described above are intended for easier understanding of the invention and do not limit the interpretation of the invention. Elements included in the embodiments and the modified examples, and arrangements, materials, conditions, shapes, sizes, and the like of the elements are not limited to those illustrated above, but can be appropriately changed. Further, components described in the different embodiments can be partially replaced or combined. For example, one or more components shown by dotted frames in FIG. 1 may be appropriately omitted.

Hereinafter, technical ideas and their functional effects grasped from the embodiments and the modified examples described above will be described.

Idea 1

A liquid ejecting apparatus including a recording unit having a liquid ejecting head that ejects liquid from nozzles, a first tank which is arranged at a position lower than the liquid ejecting head in a vertical direction and stores liquid to be supplied to the liquid ejecting head, a second tank which is arranged at a position lower than the liquid ejecting head in the vertical direction and receives liquid that has not been ejected by the liquid ejecting head, a circulation path that circulates liquid among the first tank, the liquid ejecting head, and the second tank, and a pump that sends liquid from the second tank to the first tank, a first atmosphere opening valve that switches the first tank between a sealed state and an atmosphere opening state, a second atmosphere opening valve that switches the second tank between a sealed state and an atmosphere opening state, a first pressure adjusting unit that can pressurize the first tank, and a second pressure adjusting unit that can depressurize the second tank. In the liquid ejecting apparatus, the second tank separately has a first opening that communicates with the second pressure adjusting unit and a second opening that communicates with the second atmosphere opening valve, and the second opening is arranged at a position lower than the first opening in the vertical direction.

According to the Idea 1 described above, if an over supply of liquid to the second tank occurs due to a meniscus destruction of the nozzle caused by vibration or the like or due to a failure or the like of the liquid ejecting apparatus, in the second tank, the over-supplied liquid reaches the second opening before reaching the first opening. Thereby, it is possible to cause the over-supplied liquid to overflow from the second atmosphere opening valve through the second opening, so that it is possible to prevent the over-supplied liquid from accidentally leaking from the second tank to the second pressure adjusting unit and damaging the second pressure adjusting unit.

Idea 2

The liquid ejecting apparatus described in the Idea 1, in which a head space of the second tank is greater than a volume of the circulation path from the second tank to the liquid ejecting head.

According to the Idea 2, for example, when a meniscus destruction of the nozzle occurs, liquid in the circulation path from the second tank to the liquid ejecting head flows into the second tank, however, all the liquid flowing into the second tank can be stored in the second tank. Thereby, it is possible to suppress liquid overflow from the second tank.

Idea 3

A liquid ejecting apparatus including a liquid ejecting head that ejects liquid from nozzles, a recording unit having a first tank which is arranged at a position higher than the liquid ejecting head in a vertical direction and stores liquid to be supplied to the liquid ejecting head, a second tank which is arranged at a position lower than the liquid ejecting head in the vertical direction and receives liquid that has not been ejected by the liquid ejecting head, a circulation path that circulates liquid among the first tank, the liquid ejecting head, and the second tank, and a pump that sends liquid from the second tank to the first tank, a first atmosphere opening valve that switches the first tank between a sealed state and an atmosphere opening state, a second atmosphere opening valve that switches the second tank between a sealed state and an atmosphere opening state, a first pressure adjusting unit that can pressurize the first tank, and a second pressure adjusting unit that can depressurize the second tank. In the liquid ejecting apparatus, the second tank separately has a first opening that communicates with the second pressure adjusting unit and a second opening that communicates with the second atmosphere opening valve, and the second opening is arranged at a position lower than the first opening in the vertical direction.

According to the Idea 3 described above, in the same manner as described above, if an over supply of liquid to the second tank occurs, in the second tank, the over-supplied liquid reaches the second opening before reaching the first opening. Thereby, it is possible to cause the over-supplied liquid to overflow from the second atmosphere opening valve through the second opening, so that it is possible to prevent the over-supplied liquid from reaching the second pressure adjusting unit. Therefore, it is possible to reduce failure of the second pressure adjusting unit.

Idea 4

The liquid ejecting apparatus described in any one of the Ideas 1 to 3, further including a main tank which stores liquid and is arranged at a position higher than the second tank in a vertical direction, a supply flow path that communicates the main tank with the second tank, and a supply valve that can open and close the supply flow path.

According to the Idea 4 described above, the liquid can be supplied from the main tank to the second tank, so that it is possible to continuously use the liquid ejecting apparatus. Further, even when a cause of the over supply of liquid to the second tank is a failure of the supply valve, as described above, it is possible to cause the over-supplied liquid to overflow from the second atmosphere opening valve through the second opening.

Idea 5

The liquid ejecting apparatus described in the Idea 4, in which each of the first atmosphere opening valve and the supply valve is a normal close type opening/closing valve which opens when a current is applied and closes when no current is applied, and the second atmosphere opening valve is a normal open type opening/closing valve which closes when a current is applied and opens when no current is applied.

According to the Idea 5 described above, the opening/closing valve (supply valve), which becomes a cause of a large amount of liquid flowing into the second tank due to some trouble, is a normal close type valve. Thereby, it is possible to suppress liquid overflow from the second tank when the power source is OFF.

Idea 6

The liquid ejecting apparatus described in any one of the Ideas 1 to 5, further including a liquid receiving portion that can receive liquid overflowing from at least one of the first tank and the second tank.

According to the Idea 6 described above, when the liquid overflows from at least one of the first tank and the second tank, the liquid receiving portion can receive the liquid, so that it is possible to restrain the liquid from leaking to the outside of the apparatus.

Idea 7

The liquid ejecting apparatus described in any one of the Ideas 1 to 6, further including a discharge failure detection means that detects a discharge failure of a nozzle. In the liquid ejecting apparatus, a plurality of nozzles are provided in the liquid ejecting head, and when the discharge failure detection means detects discharge failures of a predetermined number of nozzles, in a state in which the first tank is sealed by the first atmosphere opening valve and the second tank is opened to atmosphere by the second atmosphere opening valve, a pressure in the first tank is made positive by the first pressure adjusting unit, and thereby liquid is sent from the first tank to the liquid ejecting head, and further liquid is sent from the second tank to the first tank by the pump until a liquid level height of the second tank becomes lower than a reference height.

According to the Idea 7 described above, it is possible to recognize that liquid returns to the second tank from the liquid ejecting head and reduce liquid in the second tank before the second pressure adjusting unit depressurizes the second tank. When the nozzles are in a normal state, the above operation is not performed, so that it is possible to shorten maintenance time.

Idea 8

The liquid ejecting apparatus described in any one of the Ideas 1 to 7, further including a gas-liquid separator that permits a passage of gas and does not permit a passage of liquid, the gas-liquid separator is provided between the first opening and the second pressure adjusting unit.

According to the Idea 8 described above, even if liquid reaches the first opening, it is possible for the gas-liquid separator to prevent the liquid from reaching the second pressure adjusting unit. Thereby, it is possible to further restrain the liquid from flowing into the second pressure adjusting unit.

Idea 9

The liquid ejecting apparatus described in any one of the Ideas 1 to 8, in which a flow path resistance of the circulation path from the first tank to the liquid ejecting head is greater than a flow path resistance of the circulation path from the liquid ejecting head to the second tank.

According to the Idea 9 described above, it is possible to apply an appropriate negative pressure to eject liquid to the nozzles.

Idea 10

The liquid ejecting apparatus described in any one of the Ideas 1 to 9, in which, the first pressure adjusting unit has a pressurizing pump that can pressurize the first tank, and the second pressure adjusting unit has a depressurizing pump that can depressurize the second tank.

According to the Idea 10 described above, it is possible to easily pressurize the first tank and depressurize the second tank.

Idea 11

The liquid ejecting apparatus described in the Idea 10, in which the first pressure adjusting unit has a first pressure detection unit that detects pressure in the first tank and a first pressure adjusting valve that can open and close according to the pressure in the first tank, and the second pressure adjusting unit has a second pressure detection unit that detects pressure in the second tank and a second pressure adjusting valve that can open and close according to the pressure in the second tank.

According to the Idea 11 described above, it is possible to perform accurate pressure adjustment on the first tank and the second tank. Thereby, for example, it is possible to stabilize pressure in the liquid ejecting head when ejecting liquid, so that it is possible to stabilize quality of liquid ejection.

Idea 12

The liquid ejecting apparatus described in the Idea 1 or 11, further including a plurality of the recording units, a first common space portion that communicates with the first tanks of the plurality of the recording units, and a second common space portion that communicates with the second tanks of the plurality of the recording units. In the liquid ejecting apparatus, the pressurizing pump communicates with the first tanks of the plurality of the recording units through the first common space portion, and the depressurizing pump communicates with the second tanks of the plurality of the recording units through the second common space portion.

According to the Idea 12 described above, it is possible to pressurize a plurality of the first tanks by using one pressurizing pump and depressurize a plurality of the second tanks by using one depressurizing pump. Thereby, when there is a plurality of recording units, it is possible to reduce cost and simplify apparatus configuration.

Idea 13

The liquid ejecting apparatus described in the Idea 12, further including a liquid capturing portion in a space part connecting the second tank with the second common space portion.

According to the Idea 13 described above, even when liquid flows into the space part, a meniscus (liquid film) easily stops at the liquid capturing portion. Therefore, even when the second pressure adjusting unit depressurizes the second tank, the liquid is difficult to be sucked to the second common space portion.

Idea 14

The liquid ejecting apparatus described in any one of the Ideas 10 to 13, in which the pressurizing pump and the depressurizing pump are a common air pump that sends air from the second tank to the first tank.

According to the Idea 14 described above, one air pump substitutes for the pressurizing pump and the depressurizing pump. Thereby, it is possible to further reduce cost and simplify apparatus configuration.

The entire disclosure of Japanese Patent Application No. 2017-040156, filed Mar. 3, 2017 is expressly incorporated by reference herein.

What is claimed is:

1. A liquid ejecting apparatus comprising:

a liquid ejecting head that ejects liquid from nozzles formed in a nozzle surface;

a recording unit having a first tank that stores the liquid to be supplied to the liquid ejecting head, a second tank which receives the liquid that has not been ejected by the liquid ejecting head and whose lower surface is arranged vertically lower than the nozzle surface, a circulation path that circulates the liquid among the first tank, the liquid ejecting head, and the second tank, and a pump that sends the liquid from the second tank to the first tank;

a first atmosphere opening valve that switches the first tank between a sealed state and an atmosphere opening state;

a second atmosphere opening valve that switches the second tank between a sealed state and an atmosphere opening state;

a first pressure adjusting unit that can pressurize the first tank; and a second pressure adjusting unit that can depressurize the second tank, wherein the second tank has a first opening that communicates with the second pressure adjusting unit and a second opening that communicates with the second atmosphere opening valve, and the second opening is arranged at a position lower than the first opening in a vertical direction.

2. The liquid ejecting apparatus according to claim 1, wherein a head space of the second tank is greater than a volume of the circulation path from the second tank to the liquid ejecting head.

3. The liquid ejecting apparatus according to claim 1, further comprising:

a main tank which stores the liquid and whose lower surface is arranged vertically higher than the lower surface of the second tank;

a supply flow path that communicates the main tank with the second tank; and a supply valve that can open and close the supply flow path.

4. The liquid ejecting apparatus according to claim 3, wherein each of the first atmosphere opening valve and the supply valve is a normal close type opening/closing valve which opens when a current is applied and closes when no current is applied, and the second atmosphere opening valve is a normal open type opening/closing valve which closes when a current is applied and opens when no current is applied.

5. The liquid ejecting apparatus according to claim 1, further comprising:

a liquid receiving portion that can receive the liquid overflowing from at least one of the first tank and the second tank.

6. The liquid ejecting apparatus according to claim 1, further comprising:

a discharge failure detection unit that detects a discharge failure of the nozzle, wherein a plurality of the nozzles are provided in the liquid ejecting head, and when the discharge failure detection unit detects discharge failures of a predetermined number of the nozzles, in a state in which the first tank is sealed by the first atmosphere opening valve and the second tank is opened to atmosphere by the second atmosphere opening valve, a pressure in the first tank is made positive by the first pressure adjusting unit, and thereby the liquid is sent from the first tank to the liquid ejecting head, and further the liquid is sent from the second tank to the first tank by the pump until a liquid level height of the second tank becomes lower than a reference height.

7. The liquid ejecting apparatus according to claim 1, further comprising:

a gas-liquid separator that permits a passage of gas and does not permit a passage of liquid, wherein the gas-liquid separator is provided between the first opening and the second pressure adjusting unit.

8. The liquid ejecting apparatus according to claim 1, wherein a flow path resistance of the circulation path from the first tank to the liquid ejecting head is greater than a flow path resistance of the circulation path from the liquid ejecting head to the second tank.

9. The liquid ejecting apparatus according to claim 1, wherein the first pressure adjusting unit has a pressurizing pump that can pressurize the first tank, and the second pressure adjusting unit has a depressurizing pump that can depressurize the second tank.

10. The liquid ejecting apparatus according to claim 9, wherein the first pressure adjusting unit has a first pressure detection unit that detects pressure in the first tank and a first pressure adjusting valve that can open and close according to the pressure in the first tank, and the second pressure adjusting unit has a second pressure detection unit that detects pressure in the second tank and a second pressure adjusting valve that can open and close according to the pressure in the second tank.

11. The liquid ejecting apparatus according to claim 9, further comprising:

a plurality of the recording units;

a first common space portion that communicates with the first tanks of the plurality of the recording units; and a second common space portion that communicates with the second tanks of the plurality of the recording units, wherein the pressurizing pump communicates with the first tanks of the plurality of the recording units through the first common space portion, and the depressurizing pump communicates with the second tanks of the plurality of the recording units through the second common space portion.

12. The liquid ejecting apparatus according to claim 11, further comprising:

a liquid capturing portion which is located in a space part connecting the second tank with the second common space portion and captures the liquid.

13. The liquid ejecting apparatus according to claim 9, wherein the pressurizing pump and the depressurizing pump are a common air pump that sends air from the second tank to the first tank.

* * * * *